United States Patent [19]

Goloff et al.

[11] 4,143,629

[45] Mar. 13, 1979

[54] SPEED CONTROLLED HYDRAULIC LIFTER FOR INTERNAL COMBUSTION ENGINES

[75] Inventors: Alexander Goloff, East Peoria; Frank E. Keske, Chillicothe; Darrell E. Stafford; Michael K. Stratton, both of Peoria, all of Ill.

[73] Assignee: Caterpillar Tractor Co., Peoria, Ill.

[21] Appl. No.: 760,070

[22] Filed: Jan. 17, 1977

[51] Int. Cl.[2] ..... F01L 1/24

[52] U.S. Cl. ..... 123/90.16; 123/90.55; 123/90.36

[58] Field of Search ..... 123/90.15, 90.37, 90.57, 123/90.12, 90.43, 90.35, 90.36, 90.46, 90.55, 90.63, 90.16

[56] References Cited

U.S. PATENT DOCUMENTS

| | | | |
|---|---|---|---|
| 1,624,497 | 4/1927 | McAllister | 123/90.36 |
| 1,792,836 | 2/1931 | Handwerker | 123/90.36 |
| 1,965,517 | 7/1934 | Vitalini | 123/90.12 |
| 2,019,252 | 10/1935 | Cottingham | 123/90.12 |
| 2,309,740 | 2/1943 | Voorhies | 123/90.16 |
| 2,494,183 | 1/1950 | Lincoln | 123/90.16 |
| 3,142,290 | 7/1964 | Lesher | 123/90.57 |
| 3,385,274 | 5/1968 | Shunta et al. | 123/90.55 |
| 3,441,009 | 4/1969 | Rafanelli | 123/90.15 |
| 3,897,761 | 8/1975 | Fleischer et al. | 123/90.36 |
| 3,967,602 | 7/1976 | Brown | 123/90.35 |

*Primary Examiner*—Ronald H. Lazarus
*Assistant Examiner*—Jeffrey L. Yates
*Attorney, Agent, or Firm*—Wegner, Stellman, McCord, Wiles & Wood

[57] ABSTRACT

An internal combustion engine including at least one cylinder defining a combustion chamber, a piston reciprocal within the cylinder, at least one port in the combustion chamber, a valve within the port and movable between positions opening and closing the port, a camshaft, a valve train operated by the camshaft for moving the valve between the positions, the valve train including a hydraulic valve lifter, an oil supply line for providing oil to the hydraulic valve lifter and a device for at least partially interrupting the supply of oil to the hydraulic valve lifter for predetermined operational conditions of the engine to thereby intentionally induce valve lash into the system at the predetermined operational conditions. At low engine speeds or during cranking for startup, the induced valve lash increases compression to maximize engine efficiency at low speeds or during startup, while at overspeed conditions, prevents valve train separation and/or lifter pumpup to prevent interference between valves and pistons which would damage the engine.

3 Claims, 3 Drawing Figures

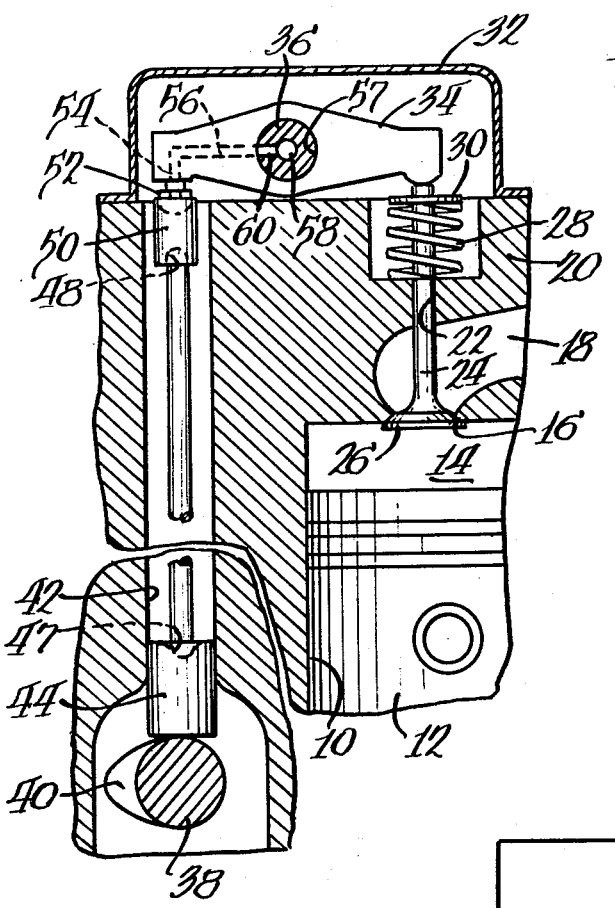
Fig. 1.
Fig. 2.
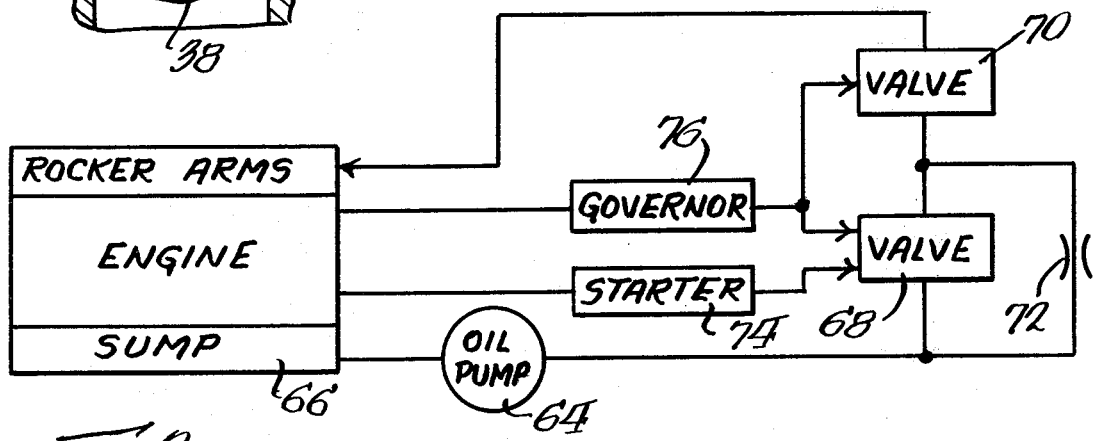
Fig. 3.
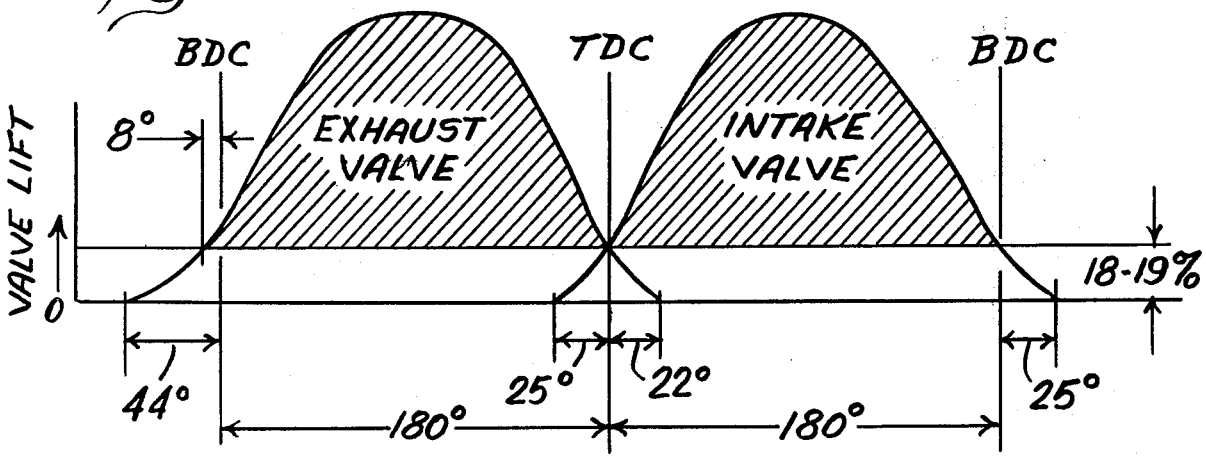

SPEED CONTROLLED HYDRAULIC LIFTER FOR INTERNAL COMBUSTION ENGINES

BACKGROUND OF THE INVENTION

This invention relates to internal combustion engines and, more specifically, to speed controlled hydraulic valve lifters in such engines. The invention is particularly advantageous when used in reciprocating diesel engines but may also be employed with efficacy in reciprocating spark ignition engines.

Reciprocating diesel engines of the type installed in vehicles must be capable of starting at low ambient temperatures and quickly warming up with a minimum of generation of so-called "white smoke" an undesirable emission, which is typical of the operation of a diesel engine which is cold. Moreover, since such engines are frequently driven by the vehicle, as when the vehicle is coasting downhill, valve train separation must not be accompanied by a significant growth in the length of the train since such growth may cause interference between the piston and the valve heads. Such interference inevitably bends the valves, or, in severe cases, breaks the valve heads from the stems causing extensive damage to the engine.

For the foregoing reasons, hydraulic valve lifters have not been used to any appreciable extent in diesels used for driving vehicles. The undesirable pumpup characteristics of hydraulic valve lifters cause the aforementioned undesirable growth in the length of the valve train at high speeds.

In a typical vehicular diesel, there is also considerable overlap in the operation of the valves. Typically, the intake valve will close after bottom dead center to make use of the inertia of the air within the manifold in the port to provide a ram effect which results in trapping more air within the cylinder. The exhaust valve is opened considerably before bottom dead center is attained in order to provide sufficient time for exhaust blowdown to take place and minimize back pressure. At the end of the exhaust process, the intake valve has already opened a considerable amount which produces mixing of the fresh air charge with combustion products at low engine speeds but not at higher speeds. Such valve overlap is harmful at low speeds but is beneficial at higher speeds because of improved breathing.

Moreover, because the intake valve closes after bottom dead center, at low speeds or during cranking for startup, a certain amount of the air in the cylinder in expelled backwardly into the intake manifold to lower the design effective compression ratio, for example, from 18:1 down to 17:1. As a consequence, the gas temperature at top dead center during the compression stroke, where fuel is injected, is lowered thereby making the engine more difficult to start and/or decreasing operating efficiency at low speeds.

SUMMARY OF THE INVENTION

The present invention is directed to overcoming one or more of the problems as set forth above.

An exemplary embodiment of the invention includes an internal combustion engine having at least one cylinder defining a combustion chamber, a piston reciprocal within the chamber, and at least one port in the combustion chamber. A valve is within the port and is movable between positions opening and closing the port. The engine includes a camshaft and a valve train operated thereby for moving the valve between its positions and the valve train includes a hydraulic valve lifter. Means are provided for supplying oil to the hydraulic lifter and means are provided for at least partially interrupting the supply of oil to the hydraulic valve lifter for predetermined operational conditions of the invention to intentionally introduce valve lash into the valve train for purposes to be described.

Other objects and advantages will become apparent from the following specification taken in connection with the accompanying drawings.

DESCRIPTION OF THE DRAWINGS

FIG. 1 is a somewhat schematic, partial sectional view of a reciprocating internal combustion engine embodying the invention;

FIG. 2 is a schematic of portions of the invention; and

FIG. 3 is a timing diagram illustrating the application of the present invention to a typical internal combustion, reciprocating engine.

DESCRIPTION OF THE PREFERRED EMBODIMENT

An exemplary embodiment of an engine made according to the invention is illustrated in FIG. 1 and is seen to include a cylinder 10 having a piston 12 mounted for reciprocation therein in a conventional fashion. The cylinder 10 defines a combustion chamber 14 having plural valve ports 16, which may be conventionally arranged, opening thereto. The port 16 is in fluid communication by means of a conduit 18 with an intake manifold or an exhaust manifold.

The engine housing 20 includes a bore 22 aligned with the port 16 for reciprocally receiving the stem 24 of a valve 26 which is movable between positions opening and closing the port 16. A spring 28 surrounds a portion of the stem 24 and is interposed between a washer 30 secured thereto to normally bias the valve 26 to the closed position illustrated in FIG. 1.

The engine will typically include a cover 32 housing a rocker arm 34 pivotally mounted on a rocker arm shaft 36.

The engine further includes a camshaft 38 having a series of cams 40 thereon along with a bore 42 reciprocally receiving a tappet or cam follower 44 which follows the cam 40. A push rod 46 has one end received in a socket 47 in the cam follower 44 and its other end in a socket 48 in a hydraulic valve lifter 50 of conventional construction. The hydraulic valve lifter 50 is supported by a ball socket 52 adjacent one end of the rocker arm 34 so that the hydraulic valve lifter 50 is operatively interposed between the push rod 48 and the rocker arm 34 as illustrated so that the valve 26 will be reciprocated in response to rotation of the camshaft 38.

The engine further includes a bore 54 located in the rocker arm and the ball socket 52 through which oil is directed to the valve lifter 50. A passage 56 extends from the bore 54 to the bore 57 in the rocker arm 34 in which the rocker arm shaft 36 is received. The rocker arm shaft 36 is provided with an axial bore 58 having a series of radially extending passages 60, one at each rocker arm 34, for conveying lubricant to the rocker arm to reduce friction at the interface between the rocker arm 34 and the rocker arm shaft 36. Oil emanating from the passages 60, after lubricating bearings or the like at the interface, will be received by the passage 56 and conveyed via the bore 54 to the hydraulic valve lifter 50 to fill the same in a conventional fashion.

Referring now to FIG. 2, the oil supplied to the passage 58 is provided by a conventional oil pump 64 driven by the engine and supplied with oil from the engine sump 66 in a conventional fashion. According to the invention, the output of the oil pump 64, insofar as it is to be applied to the bores 58 in one or more rocker arm shafts 36, is directed to a first valve 68, which may be solenoid operated. Oil passing through the valve 68 is directed to a second valve 70, which also may be solenoid operated, and then to the bores 58 in the rocker arm shafts 36.

The valve 68 has restricted flow bypass 72 connected across the same, as illustrated. Consequently, if the valve 70 is closed, no oil will be supplied to the rocker arms or to the hydraulic valve lifters 50. On the other hand, if the valve 70 is open and the valve 68 is closed, a very low rate of flow will occur, the rate being regulated by the size of the orifice 72. Lastly, if both the valves 68 and 70 are open, there will be a full flow of oil to the rocker arm shaft 36, and thus to the hydraulic valve lifters 50.

According to one embodiment of the invention, the valves 68 and 70 are normally open but may be caused to close for certain predetermined operational conditions of the engine. For example, the engine starter system 74 may be provided with an output to the valve 68 to cause the valve 68 to be closed whenever the engine is being cranked for startup. The system also includes a governor 76 driven by the engine and thereby responsive to engine speed. The governor 76 is operative, at predetermined low engine speeds, such as the typical so-called "low" idle, to cause the valve 68 to be closed. The governor 76 may also provide an output to the valve 70 to cause the valve 70 to close at excessive engine speeds, that is, speeds in excess of some rated speed at which damage to the engine could occur due to, for example, pumpup of the valve lifters 50 and the resulting interference between the valves and the associated pistons.

Those skilled in the art will recognize that the partial or entire interruption of the flow of oil to the conduits 58 and the rocker arm shafts 36 will result in the starving of the hydraulic valve lifters 50 with the result that they will collapse causing valve lash. In the case of an overspeed condition being determined by the governor 76 with the resultant closing of the valve 70, considerable abnormal noise will be generated with the introduction of valve lash to warn the operator of the engine of the overspeed condition and provide an indication that the engine should be taken to a maintenance facility and inspected for possible damage. At the same time, the starvation of the lifters 50 will prevent lifter buildup and the resultant valve train growth that could cause damaging interference between the valves 26 and the piston 12. For low speed engine conditions, including cranking during startup, if the valve lifters are primed (from prior operation) with the interruption of oil flow thereto, they will collapse in a very short period of time, or if not primed, they cannot prime and remain in a collapsed condition. Again, valve lash is introduced into the system.

Preferably, the system is constructed such that the valve lash introduced will be such as to effectively eliminate overlap in the opening of the exhaust valve and the intake valve and further cause the opening and closing points of both valves to occur at or about bottom dead center or top dead center as the case may be in the respective exhaust and intake strokes. In a typical diesel, the lash introduced will be on the order of 18 or 19% of the total valve lift, as illustrated in FIG. 3. Thus, in the case of an exhaust valve that would normally open at about 44° prior to bottom dead center, the introduction of such a degree of valve lash will delay the opening to only about 8° before bottom dead center. The late opening of the exhaust valve makes it possible to extract more mechanical energy out of the gas since it undergoes full expansion, that is, for the full stroke of the engine. At the same time, the introduced valve lash will cause the exhaust valve to close at about top dead center when normally it would not close until about 22° after top dead center. At the same time, the usual opening of the intake valve at 25° prior to top dead center is delayed to about top dead center so that there is no overlap between the opening and the closing of the exhaust and intake valves with the result that there is no mixing of fresh combustion air with combustion gases with the consequence that the overall oxygen content of the gas being compressed will be greater, promoting more efficient combustion.

Similarly, the closing of the intake valve, which typically would occur at 25° past bottom dead center is made to occur earlier at about bottom dead center so that air is not forced back into the intake manifold, thereby lowering the effective compression ratio of the engine with the resultant lowering of the gas temperature at full compression when fuel is injected.

Thus, the valve events are markedly improved for cranking conditions and for operating at low engine speed when valve lash is introduced into the system according to the present invention. The resulting increased efficiency is particularly advantageous when the engine is cold since a faster warmup is promoted with the result that white smoke emissions are reduced. Similarly, because of the increased effective compression ratio, during cranking for startup, the starting ability of the engine is also enhanced.

A particular feature of the invention is the location of the hydraulic valve lifter at the position illustrated in FIG. 1. The location facilitates the use of a separate oil line for supplying oil to the lifter, which oil line can be more readily connected to the valves 68 and 70, as illustrated. Maintenance is also facilitated in that the valve lifter may be readily exposed simply by removal of the cover 32 and shifting of the rocker arm 34.

The system is advantageous in that overspeed conditions resulting in disastrous destruction of engine parts is eliminated since valve lifter pumpup is prevented. And, of course, through the use of hydraulic lifters, the usual need for valve lash adjustment is diesel engines of the type employed with vehicles is eliminated.

The embodiments of the invention in which an exclusive property or privilege is claimed are defined as follows:

1. An internal combustion engine comprising:
at least one cylinder defining a combustion chamber;
a piston reciprocable within said cylinder;
at least one port in said combustion chamber;
a valve within said port and movable between positions opening and closing said port;
a camshaft;
a valve train operated by said camshaft for moving said valve between said positions;
said valve train including a hydraulic valve lifter;
means for supplying oil to said hydraulic valve lifter; and means for at least partially interrupting the supply of oil to said hydraulic valve lifter to at least partially starve the valve lifter of oil thereby intentionally introducing lash into said valve train for predetermined operational conditions of said engine, said interrupting means comprising an oil control valve and means responsive to the speed of the engine for operating said control valve, said operating means causing said control valve to close to at least partially interrupt the supply of oil; and an oil flow restriction in bypass relation to said control valve.

2. The internal combustion engine of claim 1 wherein said operating means causes said control valve to close at low engine speeds.

3. An internal combustion engine comprising:

at least one cylinder defining a combustion chamber;

a piston reciprocal within said cylinder;

at least one port in said combustion chamber;

a valve within said port and movable between positions opening and closing said port;

a camshaft;

a valve train operated by said camshaft for moving said valve between said positions;

said valve train including a hydraulic valve lifter;

means for supplying oil to said hydraulic valve lifter; and means for at least partially interrupting the supply of oil to said hydraulic valve lifter to at least partially starve the valve lifter to oil thereby intentionally introducing lash into said valve train for predetermined operational conditions of said engine, said interrupting means comprising an oil control valve and means responsive to the speed of the engine for operating said control valve, said responsive means comprising a governor for sensing an overspeed condition of the engine, said valve being located in said oil supplying means and responsive to said governor for closing to halt oil flow to said hydraulic valve lifter when said engine overspeeds.

* * * * *